United States Patent [19]

Uehara

[11] Patent Number: 4,794,364

[45] Date of Patent: Dec. 27, 1988

[54] THERMOSTAT

[75] Inventor: Yasuhiro Uehara, Kanagawa, Japan

[73] Assignee: Fuji Xerox Co., Ltd., Tokyo, Japan

[21] Appl. No.: 53,863

[22] Filed: May 26, 1987

[30] Foreign Application Priority Data

May 24, 1986 [JP] Japan ..... 61-118431

[51] Int. Cl.[4] ..... H01H 37/52

[52] U.S. Cl. ..... 337/354; 337/372; 337/380

[58] Field of Search ..... 337/354, 372, 380, 343, 337/365, 112

[56] References Cited

U.S. PATENT DOCUMENTS

| | | | |
|---|---|---|---|
| 2,954,447 | 9/1960 | Bolèsky et al. | 337/354 |
| 3,014,105 | 12/1961 | Schmitt | 337/354 |
| 3,755,770 | 8/1973 | Andersen | 337/354 |
| 4,048,611 | 9/1977 | Kuczynski et al. | 337/343 |
| 4,091,354 | 5/1978 | Deubel et al. | 337/380 |
| 4,533,894 | 8/1985 | Bishop et al. | 337/354 |
| 4,570,148 | 2/1986 | Ferroni et al. | 337/372 |

*Primary Examiner*—H. Broome

*Attorney, Agent, or Firm*—Finnegan, Henderson, Farabow, Garrett, & Dunner

[57] ABSTRACT

A thermostat comprises a generally circular supporting frame; a disk mounted on the frame movable between two stable positions in response to changes in the temperature of the disk, a pin slidable mounted in the frame for movement in response to movement of the disk between the two stable positions; an electrical contact switch including at least one movable contact responsive to slidable movement of the pin for opening and closing the contact switch; and spacers between the frame and the disk for reducing transfer of heat by conduction from the disk to the frame for increasing the thermal response of the thermostat.

5 Claims, 3 Drawing Sheets

FIG. 1
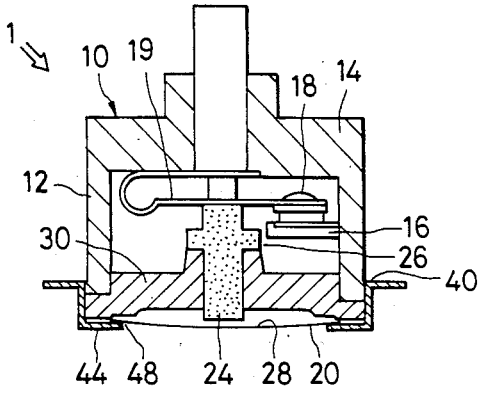
FIG. 1A
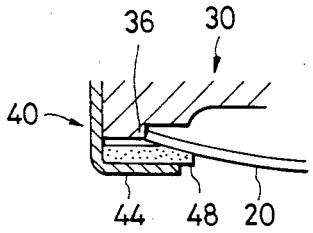
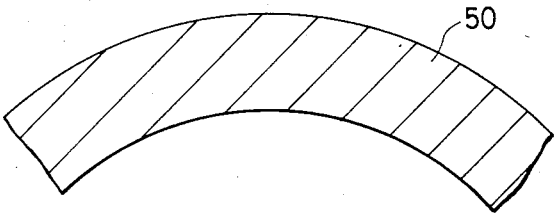
FIG.8
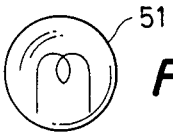
FIG. 9
FIG. 2
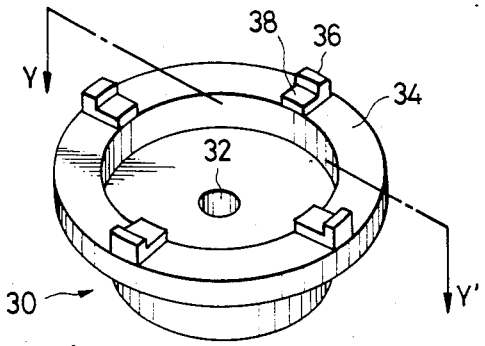
FIG. 2A
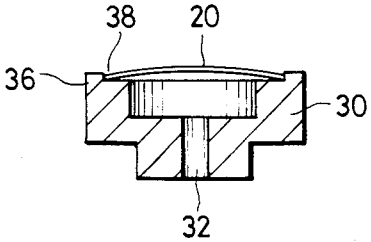

THERMOSTAT

BACKGROUND OF THE INVENTION

Field of the Invention

The present invention relates to a thermostat, and particularly relates to a device for preventing the abnormal rise in the temperature of a fixation unit for thermally fixing a toner image on the surface of a carrier in a dry electronic copying machine.

Description of the prior art

When a toner image transferred from a photosensitive member to copying paper is passed through a fixation unit, the grains of the toner of the image are bonded to each other and to the copying paper by heat, pressure, a solvent or the like, so that the toner image is fixed on the copying paper. For the fixation, the optimal one of various fixation methods is selected in consideration of the speed of copying, the consumption of electric power, the volume, maintenance and performance of the copying machine and so forth.

With a roller fixation method, heat energy is imparted to the toner and the copying paper through thermal conduction as the copying paper carrying the toner image is passed through between a heating roller and a pressure roller. At that time, heat is directly transmitted from the surface of the heating roller to the copying paper and pressure is applied to the paper by the pressure roller, so that the toner image is fixed on the paper. The heating roller is made of a material high in heat resistance, parting property and mechanical strength. The pressure roller has a surface layer of appropriate elasticity, and performs fixation nipping. the surface layer needs to have the same quality as the heating roller.

A fixation unit for use in the roller fixation method has advantages that the heat efficiency of the unit is as high as 60 to 80%, the unit can be applied to a high-speed copying machine and the safety of the unit is high. For that reason, the fixation unit is widely used in practice.

In a fixation unit for carrying out a radiant fixation method, heat energy is imparted to the toner and the paper by radiant heat transmission to fix the toner image on the paper. For such fixation, an infrared lamp, a xenon flash lamp or the like is used as a heat source. In the radiant fixation method, the degree of the fixation depends on the shade of the toner image. It is typical that the degree of the fixation is high for the high shade areas of the toner image, but is low for the low shade areas thereof because many of the grains of the toner are isolated from each other in the low-shade portion of the toner image, so as not to absorb sufficient heat. A fixation unit for exercising the radiant fixation method has advantages that the construction of the unit is simple, the unit can be made compact, the cost thereof is low and the warm-up time thereof is short. The fixing property of the fixation unit employing the xenon flash lamp is higher than that of the fixation unit employing the infrared lamp. However, the power supply of the fixation unit employing the xenon flash lamp is heavier and more expensive than that of the fixation unit employing the infrared lamp.

In another pressure fixation method which recently has been receiving more and more attention, pressure is applied to a toner made of a pressure-sensitive substance such as paraffin, wax and a rubber-like soft polymer to perform fixation. Normally, a pressure of 20 to 40 $kg/cm^2$ is applied to the toner to lower the viscosity thereof and imprequate the toner in to the fibers of copying paper.

A fixation unit for exercising this pressure fixation method has advantages that the unit does not need a heat source and warm-up period. However, this fixation unit has a still uneliminated disadvantage that the fixation of the toner often is not sufficiently performed.

Among the other above-described fixation methods, a heating fixation method is widely use. In a well-known fixation unit for exercising the heating fixation method, a prescribed pressure is applied between a heating roller and a facing pressure roller, and a carrier having an unfixed toner image is passed through between the rollers so that the toner image is fixed on the carrier. The fixation unit has advantages that the electric power consumption thereof is less than that of other heating fixation units and fires are less likely to occur due to the jamming of paper (the carrier) in this fixation section. The heating roller has a surface coating layer of a heat-resisting parting substance such as polytetrafluoroethylene (commercially named Teflon), HTV silicone rubber and RTV silicone rubber. The pressure roller is made of a heat-resisting elastic material such as silicone rubber and fluorine rubber, so that a certain contact width (usually referred to as nip) is established when the pressure roller and the heating roller are put in pressure contact with each other.

In this well-known heating fixation unit, the temperature of the surface of the heating roller needs to be raised from the room temperature level to a level necessary for the fixation. For that reason, copying cannot be started immediately after electric power is applied to a copying machine. Therefore, it takes some time to warm up the heating roller. The time normally is about 1 to 10 minutes. This is a disadvantage for the fixation unit.

In order to eliminate the disadvantage, it has been made possible to reduce the heat capacity of the heating roller and apply as heavy an electrical current as possible at first to shorten the warm-up time to 0.5 to 1 minute. If the warm-up time is shortened as mentioned above, the temperature of the heating roller is sharply raised. The rate of the rise in the temperature of the heating roller in that case is as high as 3° to 10° C./sec. Therefore, the fixation unit needs to be provided with an abnormal temperature rise prevention device. When the pressure roller is heated above a control level due to improper operation of a temperature control circuit, disconnection, short-circuiting or wrongly set position of a sensor or the like, it is detected by the device so as to stop the application of electricity to a heater to eliminate the possibility of occurrence of a fire or the like.

As a conventional abnormal temperature rise prevention device, a thermostat, a temperature control fuse or the like is connected in series with a heater. When the rise in the temperature of the heating roller is sharp, the response of the thermostat, the temperature control fuse or the like is affected so that the device sometimes does not accurately operate. At that time, even if the temperature of the heating roller has become abnormally high, the device cannot detect the rise in the temperature until the temperature goes up to a paper burning level. This is a serious problem, which is likely to happen during the warm-up of a copying machine at the start of a copying operation.

Since the electrically charged portion of each of most of such temperature control fuses is exposed, the fuse needs to be placed at an appropriate distance from the heating roller. The thermal conductivity of the other temperature control fuses, whose electrically charged portions are not exposed, is low because of the presence of an electric insulator. Therefore, generally speaking, the response of the thermostat to the abnormal rise in the temperature is better than that of each of the temperature control fuses.

FIGS. 5 and 6 show constructions of widely used thermostats 1*a*. Each of the thermostats 1*a* has a housing 10 comprising a cylindrical portion 12 and a bottom portion 14. A disk holder 30*a* is secured to the end of the cylindrical portion 12. A fixed contact 16 and a movable contact 18 corresponding thereto are provided in the housing 10. The movable contact 18 is supported by a spring plate 19, which is pushed by a moving pin 24*a* to turn the thermostat on or off. A fixed cap 40*a* is provided on the housing 10 and covers the disk holder 30*a*. The central portion of the fixed cap 40*a* is formed as a heat reception plate 46 to transmit heat to a bimetal disk 20. For that reason, the fixed cap 40*a* is made of a metal, such as aluminum or stainless steel, which has a high thermal conductivity and is unlikely to rust. When the temperature of the bimetal disk 20 of the thermostat 1*a* has exceeded a set level, the form of the bimetal disk changes from concave to convex, to displace the moving pin 24*a* toward the movable contact 18. This pushes the prescribed portion of the spring plate 19 to separate the movable contact 18 from the fixed contact 16, thus turning off the thermostat.

The bimetal disk 20 of such a conventional thermostat is heated by radiant energy from a heating roller and the conventional energy of the atmosphere, but much of the heat energy absorbed by the bimetal disk 20 is conducted to other members, such as the disk holder 30*a* and the moving pin 24*a*, which are located in contact with the bimetal disk. Thus, the amount of heat energy which acts to put the bimetal disk in to action is very small. For that reason, the rise in the temperature of the bimetal disk 20 to reach the set level is generally very slow. This deteriorates the thermal response of the thermostat 1*a*.

Also, the dessipation of heat from the bimetal disk 20 can be broadly divided into three categories. The first category is the heat transferred from the bimetal disk 20 to the disk holder 30 located in contact with the peripheral portion of the disk. The second category is the heat passing from the bimetal disk 20 to the fixed cap 40*a*. The third portion is the heat transmitted from the disk 20 to the moving pin 24*a*.

As shown in FIGS. 6 and 6A, the peripheral portion of the bimetal disk 20 is located in contact with the butt of the flange 34*a* of the disk holder 30*a* at an engaging portion 38*a* along the entire circumference of the bimetal disk. Therefore, heat transfers from the bimetal disk 20 to the disk holder 30*a* through the peripheral portion of the disk.

The disk holder of a latest conventional thermostat of the above-described type for high temperature use is not made of a heat-resisting resin, but is made of a ceramic, because the ceramic is cheap and highly heat-resisting. The thermal conductivity of the ceramic is 10 to 500 times higher than that of the heat-resisting resin. Therefore, the quantity of heat which passes from the bimetal disk of the thermostat to the disk holder is even larger.

Before the bimetal disk 20 is put in to action, the fixed cap 40*a* is in contact with the bimetal disk. For that reason, much of the heat received by the heat reception plate 46 is transmitted to the disk holder 30*a* and the housing 10 through the peripheral portion of the heat reception plate 46. Therefore, the amount of heat which effectively acts on the bimetal disk is very small.

In the conventional thermostat shown in FIG. 5, the tip of the moving pin 24*a* is located in contact with the central portion of the bimetal disk 20. Because of this contact, the heat received by the bimetal disk 20 is transmitted through the moving pin 24*a*.

For the above-described reasons, the thermal response of each of the conventional thermostats is not good.

SUMMARY OF THE INVENTION

Accordingly, it is an object of the invention to increase the accuracy and thermal response of a thermostat, in an electronic copy machine.

It is another object of the invention to reduce loss of heat due to conduction in a thermostat for an electronic copy machine.

Another object of the invention is to manimize the effective amount of heat acting on a bimetal disk in a thermostat for an electronic copy machine.

A further object of the invention is to more accurately detect heat from a heating roller in an electronic copy machine, and to minimize the loss of heat by conduction to peripheral parts of a thermostat for such a machine.

Additional objects and advantages will be apparent from the description which follows, or may be learned by practice of the invention.

In order to achieve the above objects and advantages, the thermostat of the present invention comprises a generally circular supporting frame; disk means mounted on the frame movable between two stable positions in response to changes in the temperature of the disk means; a pin slidably mounted in the frame for movement in response to movement of the disk means between the two stable positions; electrical contact means including at least one movable contact responsive to slidable movement of the pin for opening and closing the contact means; and spacer means between the frame and the disk means for reducing transfer of heat by conduction from disk means to the frame for increasing the thermal response of the thermostat.

Preferably, the spacer means includes a plurality of projections on the frame for separating the frame from direct contact with the disk means.

It is also preferred that the disk means include a bimetal disk.

The frame may include a cap having a plurality of claws thereon for securing the bimetal disk on the projections. It is preferred that the spacer means also include insulation means between the disk and each claw for further reducing heat transfer from the disk to the frame.

The pin may be in contact with the disk in only one of the two stable positions for reducing heat transfer from the disk to the pin.

BRIEF DESCRIPTION OF THE DRAWINGS

The accompanying drawings, which are incorporated in and form a part of the specification, illustrate several embodiments of the invention, and, together with the description, serve to explain the principles of the invention. Of the drawings:

FIG. 1 shows a sectional view of a thermostat provided in accordance with the present invention;

FIG. 1A shows an explanatory view indicating the fixed state of the peripheral portion of a bimetal disk;

FIG. 2 shows a perspective view of a disk holder;

FIG. 2A shows a sectional view of the disk holder;

FIG. 8 illustrates the roller depicted in FIG. 7; and

FIG. 9 illustrates the lamp provided in the roller shown in FIGS. 7 and 8.

Figure 3:
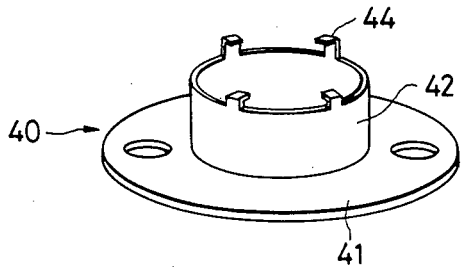
FIG. 3 shows a perspective view of a fixed cap.

Various other modifications could be made in the invention without departing from the scope or spirit of the invention.

DETAILED DESCRIPTION OF THE PREFERRED EMBODIMENT

Reference will now be made in detail to the present preferred embodiments of the invention, an example of which is illustrated in the accompanying drawings.

The device provided in accordance with the present invention is a thermostat in which the deformation of a bimetal disk caused by the change in the temperature thereof is transmitted to a movable contact through a moving pin to turn the contact on or off. The disk holder is provided with holding projections, as the only means by which the bimetal disk is held.

In another thermostat provided in accordance with the present invention, a small gap is present between the bimetal disk and the moving pin when the thermostat is in the unheated condition. The bimetal disk is held by holding projections and a fixed cap which has securing claws. A heat-insulating substance is interposed between the bimetal disk and the securing claws.

In each of the thermostats provided in accordance with the present invention, the disk holder has the holding projections at prescribed intervals. The bimetal disk is held by the holding projections and there no direct contact between the disk and the disk holder.

Since the heat-insulating substance is interposed between the holding projections of the disk holder and the bimetal disk securing claws of the fixed cap, which are engaged with the holding projections, the heat-insulating property of the thermostat is enhanced.

Since a small gap is provided between the tip of the moving pin and the bimetal disk, unnecessary transfer of heat from the disk is further avoided.

For the above-described reasons, the heat from the heating roller is transmitted more accurately to the bimetal disk of a thermostat of the present invention, so that nearly all the heat transmitted to the bimetal disk is utilized to activate the bimetal disk instead of being transmitted to other parts of the thermostat. The thermal response of the thermostat is thus improved to more precisely detect changes in the temperature of the heating roller, and to more accurately perform electricity feed stoppage or the like before the temperature rises excessively.

FIG. 1 shows the thermostat 1 comprising a housing 10, a disk holder 30 provided at the tip of the cylindrical portion 12 of the housing, and a fixed cap 40 covering the disk holder.

Figure 5:
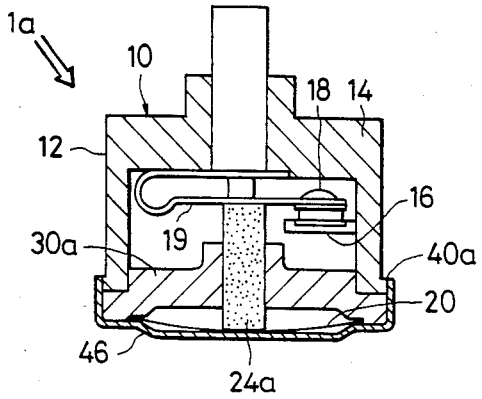
FIG. 5 PRIOR ART
FIG. 5 shows a sectional view of a conventional thermostat.
Figure 6:
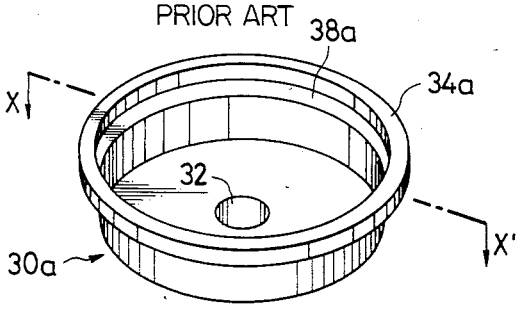
FIG. 6 PRIOR ART
FIG. 6 shows a perspective view of a conventional disk holder.
Figure 6A:
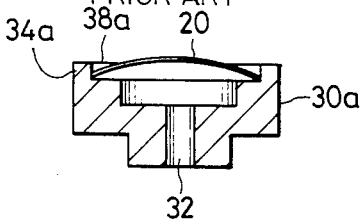
FIG. 6A PRIOR ART
FIG. 6A shows a sectional view of the conventional disk holder of FIG. 6.

The fixed contact 16 and movable contact 18 of the thermostat 1 have the same construction as in conventional thermostats shown in FIGS. 5 and 6.

In the thermostat 1, a moving pin 24 for pushing a spring plate 19 is provided with a flange 26 engaged on the projecting end of the disk holder 30 to set a very small gap between the tip of the moving pin and the central portion of a bimetal disk 20.

The bimetal disk 20 is engaged on the bottom of the disk holder 30 and secured by the claws 44 of the fixed cap 40 on the outside of the bimetal disk, as shown in FIG. 1A. The peripheral portion of the bimetal disk 20 is first put in contact with holding projections 36 on the peripheral portion of the disk holder 30. A heat-insulating substance 48 then is interposed between the peripheral portion of the bimetal disk 20 and the claws 44 of the fixed cap 40. The peripheral portion of the bimetal disk 20 then is pushed by the claws 44 on the outside of the bimetal disk.

When the thermostat 1 is at the room temperature, the central portion of the bimetal disk 20 projects downward or the disk is concave downward, as shown in FIG. 1 (the directions "downward" and "upward" are defined herein in accordance with the orientation shown FIG. 1, and are exemplary).

As shown in FIGS. 2 and 2A, the disk holder 30 has holding projections 36 located at prescribed angular intervals on the flange 34 of the disk holder and profections 36 include inner engaging portions 38, on which the peripheral portion of the bimetal disk 20 are engaged. The central portion of the disk holder 30 has a hole 32 for guiding the moving pin 24.

The width and height of each of the holding projections 36 of the disk holder 30 are about 1 mm, respectively. The disk holder 30 is made of a material whose thermal conductivity is very low or not higher than $15\times10^{-4}$ cal/°C.sec.cm, and preferably not higher than $5\times10^{-4}$ cal/°C.sec.cm.

As shown in FIG. 3, the fixed cap 40 includes a flange 41 and a cylindrical portion 42 projecting therefrom and having a plurality of claws 44 corresponding to the holding projections 36 of the disk holder. Each of the claws 44 is nearly L-shaped and has a thickness of about 0.1 to 0.3 mm and a width of about 1 mm, which is equal to that of each of the holding projections 36. At the final stage of manufacture of the thermostat 1, the fixed cap 40 is calked to the body of the housing 10 with the bimetal disk 20.

It is preferable to interpose a heat-insulating substance 48 between the bimetal disk 20 and the claws 44, as shown in FIG. 1A, to minimize the loss of heat from the bimetal disk to the fixed cap 40. If the heat-insulating substance 48 is not provided, the claws 44 maybe coated with a heat-resisting resin to minimize the above-mentioned loss of heat. The loss of heat from the bimetal disk 20 to the disk holder 30 or the fixed cap 40 is thus reduced.

Since the bimetal disk 20 is not covered with the fixed cap 40 but is almost entirely exposed to the heat source directly, the heat reception area of the bimetal disk is quite large. Also, the loss of heat from the bimetal disk 20 to other parts of the thermostat is slight. Therefore, the thermal response of the bimetal disk 20 is enhanced.

A construction for preventing the loss of heat from the bimetal disk 20 to the moving pin 24 will now be described. In the conventional thermostat 1a shown in FIG. 5, the columnar moving moving pin **24*a* is located between the central portion of the bimetal disk 20 and the spring plate 19 for the movable contact 18, so as to transmit the change over motion of the bimetal disk to the movable contact. Since the bimetal disk 20 and the moving pin 24*a* of the conventional thermostat are always in contact with each other, the heat received by the bimetal disk is transmitted to the moving pin. By contact, the moving pin 24 of the thermostat 1 provided in accordance with the present invention has a flange 26 engaged on the projecting end of the disk holder 30 to set a gap 28 between the tip of the moving pin and the bimetal disk when the disk is in the downward concave position as viewed in FIG. 1. When the bimetal disk 20 is excessively heated, the bimetal disk is deformed from the downward concave position as viewed in FIG. 1. When the bimetal disk 20 is excenssively heated, the bimetal disk is deformed from to downward concave position to an upward convex orientation, so that the central portion of the bimetal disk comes into contact with the tip of the moving pin 24 to transmit the displacement of the moving pin to the movable contact 18. The loss of heat from the bimetal disk 20 to the moving pin 24 is thus prevented when the bimetal disk is not excessively heated. Therefore, the thermal conductivity of the moving pin 24** does not need to the confined, but the pin may be made of a material of relatively high thermal conductivity such as ceramic.

The operation of a thermostat made in accordance with the present invention is hereafter described in comparison with a conventional thermostat. The thermostat 1 was mounted at a distance of 0.5 mm from the heating roller 50 of a fixation unit. the heating roller 50 comprised an aluminum core of 40 mm in diameter and 2 mm in thickness, and a coating Teflon film having a thickness of 30 μm on the core. A quartz lamp was provided as a heater 51 in the heating roller 50. A warm-up test was then conducted on the thermostat 1. In the test, the thermostat 1 was actuated about 1 minute and 20 seconds after the start of warm-up of the heating roller 50. When the thermostat 1 was operated to shut off the power, the temperature of the surface of the heating roller 50 was 230° C.

A conventional thermostat 1a, which was a model 2455M manufactured by Elmwood, as shown in FIG. 5 and whose action temperature was 150° C., was mounted at a distance of 0.5 mm from a heating roller 50 which had the same construction as that for the example described above. A warm-up test was then conducted on the thermostat **1*a*. In the test, the thermostat was actuated after about 2 minutes and 30 seconds from the start of warm-up of the heating roller 50. When the thermostat 1*a* cut off power, the temperature of the surface of the heating roller 50** was 380° C.

Figure 4:
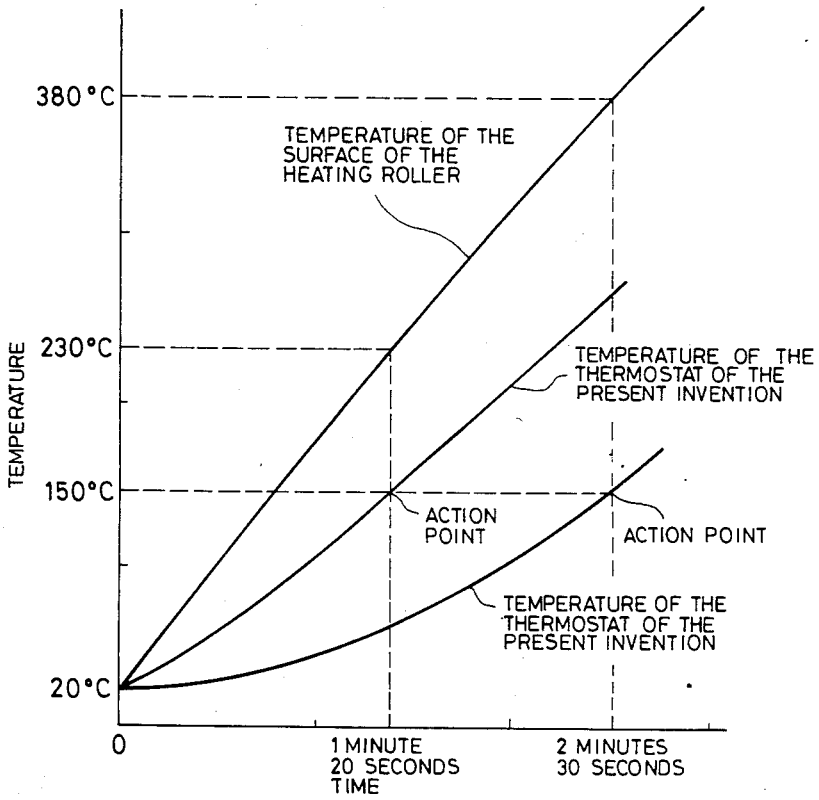
FIG. 4 shows a graph indicating the relationship between the action time and temperature of the thermostat.

FIG. 4 shows the results of both the above-described warm-up tests. When the temperature of the surface of the heating roller 50 was 380° C., smoking took place and paper was likely to be burned. At that time, not only the fixation unit, but also a component part located near the unit, had been thermally deformed and needed to be replaced. on the other hand, when the temperature of the surface of the heating roller 50 was about 230° C., no smoking took place, the fixation unit was not thermally deformed and all component parts could be used again.

Figure 7:
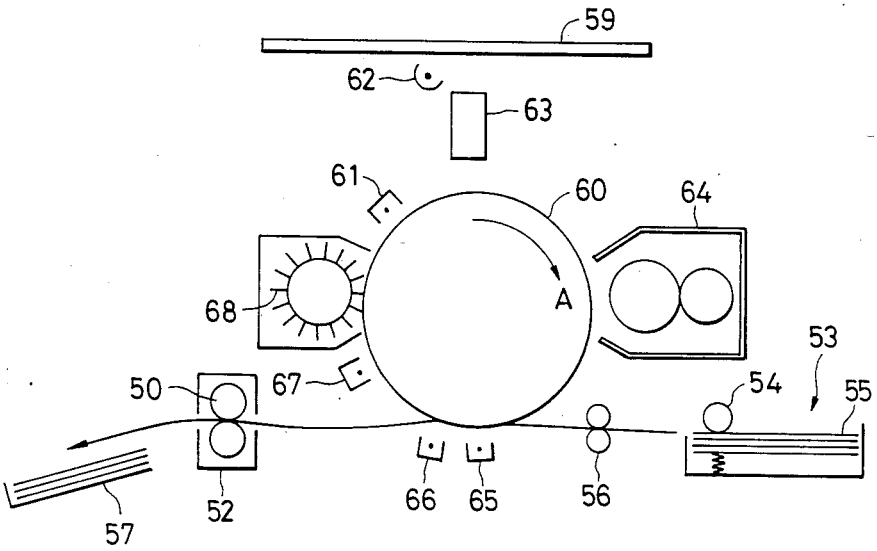
FIG. 7 shows an explanatory view indicating the construction of a copying machine to which the thermostat provided in accordance with the present invention is applied.

The construction of a copying machine having a fixation unit employing a thermostat provided in accordance with the present invention is hereafter outlined. As shown in FIG. 7, a charging corotron 61, an exposure lamp 62, optical convergence system 63, a developing unit 64, a transfer corotron 65, a separation corotron 66, an electricity eliminator 67 and a cleaner 68 are provided in a prescribed mutual positional relation around a photosensitive drum 60 in the copying machine. A paper conveyance system comprises a paper feed cassette 53, in which paper 55 is housed, a paper feed roller 54 for feeding the paper 55 from the cassette 53, and a timing roller 56 for conveying the paper 55 to an image transfer section in coordination with a toner image made on the photosensitive drum 60. The fixation unit 52 is disposed immediately downstream to the image transfer section to fix the toner image on the paper 55 to which the toner image has been transferred. A discharge tray 57 is provided downstream to the fixation unit 52.

The thermostat is disposed in the fixation unit 52 so that the thermostat corresponds to a heating roller 50. The thermostat functions to control the temperature of the heating roller 50 in fixing the toner image on the paper 55, to prevent the temperature from becoming excessively high.

The photosensitive drum 60 is rotated in the direction of an arrow A, so that the surface of the drum is uniformly charged with electricity by the charging corotron 61 before image light is irradiated upon the surface of the drum. The original on a platen 59 is illuminated by the exposure lamp 62. The image light reflected from the original is irradiated upon the surface of the photosensitive drum 60 through the optical convergence system 63 to make an electrostatic latent image on the surface of the drum. After that, toner is fed from the developing unit 64 to change the electrostatic latent image into the visible toner image. The transfer corotron 65 functions to transfer the visible toner image to the paper 55. Electric charge is eliminated by the separation corotron 66 to separate the paper 55 from the surface of the photosensitive drum 60 for convey and to the fixation unit 52.

In the fixation unit 52, the paper 55 is nipped between the heating roller 50 and a pressure roller facing the heating roller, so that the paper is heated and pressed. The toner of the toner image is melted and fixed on the paper 55 so that a copy is completed and discharged into the discharge tray 57.

After the toner image is transferred to the paper 55, toner remaining on the surface of the photosensitive drum 60 is removed of residual electric charge by the electricity eliminator 67 and then cleared away by the rotary brush of the cleaner 68 so that the toner maybe used for a next copy.

In the copying machine, the thermostat is used to keep the temperature of the heating roller 50 at an appropriate level. In other words, the thermostat functions to control the temperature of the heating roller 50 to prevent overheating and smoking or burning of the paper due to the abnormal rise in the temperature.

Although the thermostat is used as an abnormal temperature rise prevention device for the fixation unit of the electrophotographic copying machine or the like in the above-described example, the use of this thermostat is not confined thereto, but the thermostat may be used for various kinds of apparatus which need thermostat tempurature control.

The thermostat can be also used as a temperature sensor to accurately control the turn-on and turn-off of a heat source to keep the temperature of a heated object constant.

With a thermostat provided in accordance with the present invention as described above, heat from a heating source is more precisely transmitted to the bimetal disk of the thermostat and the heat received by the bimetal disk generally is not lost to other parts of the thermostat. Therefore, the thermal response of the bimetal disk is greatly enhanced. As a result, the thermostat can perform accurate control to a set temperature within a narrow range of error, and prevent abnormal rise in the temperature of the heating member. Thus, the heating member and other parts located near the heating member can be more securely protected from thermal damage.

What is claimed is:

1. A thermostat comprising:

a generally circular supporting frame, said frame including a main member and a cap having a plurality of claws mounted thereon;

a plurality of projections mounted on the main member, said projections being formed at positions corresponding to said claws;

disc means mounted on said plurality of projections and secured thereto by said plurality of claws so that said disc means is not in direct contact with said main member, said disc means being movable between two stable positions in response to changes in the temperature of said disc means;

a pin slidably mounted in said frame for movement in response to movement of the disc means between the two stable positions; and electrical contact means which includes at least one movable contact responsive to slidable movement of the pin for opening and closing the contact means.

2. The thermostat of claim 1 further comprising spacer means disposed between the plurality of claws and the disc means.

3. The thermostat of claim 2 where in the disk means includes a bimetal disk.

4. The thermostat of claim 3 wherein the spacer means also includes insulation means between the disk and each claw for further reducing heat transfer from the disk to the frame.

5. The thermostat of claim 4 wherein the pin is in direct contact with the disk in only one of the two stable positions for reducing heat transfer from the disk to the pin.

* * * * *